US011738240B2

(12) United States Patent
Molinari

(10) Patent No.: US 11,738,240 B2
(45) **Date of Patent: *Aug. 29, 2023**

(54) SPORTS BALL WITH MECHANOLUMINESCENCE

(71) Applicant: NIKE, Inc., Beaverton, OR (US)

(72) Inventor: Arthur P. Molinari, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 190 days.

This patent is subject to a terminal disclaimer.

(21) Appl. No.: 17/142,469

(22) Filed: Jan. 6, 2021

(65) Prior Publication Data

US 2021/0128987 A1 May 6, 2021

Related U.S. Application Data

(63) Continuation of application No. 16/286,713, filed on Feb. 27, 2019, now Pat. No. 10,918,914, which is a continuation of application No. 15/604,708, filed on May 25, 2017, now Pat. No. 10,258,836.

(51) Int. Cl.

| | |
|---|---|
| ***A63B 41/08*** | (2006.01) |
| ***A63B 41/02*** | (2006.01) |
| ***A63B 43/06*** | (2006.01) |
| *F21K 2/04* | (2006.01) |

(52) U.S. Cl.

CPC ..... *A63B 41/08* (2013.01); *A63B 41/02* (2013.01); *A63B 43/06* (2013.01); *A63B 2209/00* (2013.01); *A63B 2225/74* (2020.08); *F21K 2/04* (2013.01)

(58) Field of Classification Search

CPC ..... A63B 41/08; A63B 41/02; A63B 43/06; A63B 2209/00; A63B 2225/74; F21K 2/04

See application file for complete search history.

(56) References Cited

U.S. PATENT DOCUMENTS

| | | | | |
|---|---|---|---|---|
| 4,867,452 A * | 9/1989 | Finley | A63B 43/06 473/569 |
| 5,403,000 A * | 4/1995 | Woosley | A63B 43/06 473/485 |
| 5,931,752 A * | 8/1999 | Guenther | A63B 41/08 473/597 |
| 9,457,525 B2 * | 10/2016 | Berggren | B29C 66/133 |

(Continued)

*Primary Examiner* — Steven B Wong
(74) *Attorney, Agent, or Firm* — Quinn IP Law

(57) ABSTRACT

An inflatable sports ball is provided. The sports ball includes an interior bladder and a cover disposed about the interior bladder. The cover may include an outer substrate and an intermediate structure. The cover may further include an outer substrate surface, defined by the outer substrate, and a feature surface radially spaced apart from the outer substrate surface. Together the outer substrate surface and the feature surface cooperate to define an exterior surface of the cover. A mechanoluminescent material may be embedded in a portion of the cover. The mechanoluminescent material may be disposed at only one of the outer substrate surface and the feature surface, such that it is positioned to form a predetermined design on the cover. The mechanoluminescent material emits visible light in response to an externally-applied stress, such that the predetermined design illuminates when an external stress or mechanical stimulus is exerted upon the cover.

12 Claims, 10 Drawing Sheets

(56) References Cited

U.S. PATENT DOCUMENTS

| | | | | |
|---|---|---|---|---|
| 10,258,836 | B2 * | 4/2019 | Molinari | A63B 41/08 |
| 10,918,914 | B2 * | 2/2021 | Molinari | A63B 41/02 |
| 2003/0232672 | A1 * | 12/2003 | Kim | A63B 41/00<br>473/570 |
| 2013/0324333 | A1 * | 12/2013 | McNamee | A63B 41/08<br>473/599 |
| 2014/0179469 | A1 * | 6/2014 | Berggren | A63B 41/08<br>473/604 |
| 2015/0083265 | A1 * | 3/2015 | Waldrip | F21V 33/00<br>138/146 |
| 2015/0314170 | A1 * | 11/2015 | Krysiak | A63B 41/02<br>473/605 |
| 2016/0053172 | A1 * | 2/2016 | Mori | C08K 3/22<br>252/301.36 |
| 2016/0101326 | A1 * | 4/2016 | Ou | A63B 41/02<br>473/605 |
| 2016/0310803 | A1 * | 10/2016 | Yu | A63B 43/06 |
| 2017/0072270 | A1 * | 3/2017 | Shishido | A63B 45/00 |
| 2018/0243614 | A1 * | 8/2018 | Berggren | A63B 41/08 |

* cited by examiner

SPORTS BALL WITH MECHANOLUMINESCENCE

CROSS-REFERENCE TO RELATED APPLICATIONS

This application is a continuation of and claims the benefit of U.S. patent application Ser. No. 16/286,713, filed on Feb. 27, 2019, published as U.S. Patent Application Publication No. 2019/0184242, and now allowed; U.S. patent application Ser. No. 16/286,713 is a continuation of and claims the benefit of U.S. patent application Ser. No. 15/604,708, filed May 25, 2017, now U.S. Pat. No. 10,258,836. Each of U.S. patent application Ser. No. 15/604,708 and U.S. patent application Ser. No. 16/286,713 are hereby incorporated by reference in their respective entireties.

TECHNICAL FIELD

The disclosure relates to inflatable sports balls. More particularly, the disclosure relates to inflatable sports balls including a mechanoluminescent material that emits visible light in response to an externally-applied stress.

BACKGROUND

A variety of sports balls, for example, soccer balls, conventionally include a casing and an interior. The casing forms an exterior portion of the sports ball and is generally formed from a plurality of durable and wear-resistant panels joined together along abutting edge areas (e.g., with stitching, adhesives, or bonding), i.e., via a seam. Designs and other aesthetic elements may be applied to the exterior surface of the casing.

The casing may include an inner layer or intermediate structure that forms a middle portion of the sports ball that is positioned between the casing and the interior.

SUMMARY

An inflatable sports ball is provided. The sports ball includes an interior bladder and a cover disposed about the interior bladder. The cover may include an outer substrate and an intermediate structure. The outer substrate of the cover may be comprised of a plurality of panels coupled via at least one seam.

The cover may further include an outer substrate surface defined by the outer substrate and a feature surface radially spaced apart from the outer substrate surface. Together the outer substrate surface and the feature surface cooperate to define an exterior surface of the cover.

A mechanoluminescent material may be embedded in a portion of the cover. The mechanoluminescent material is disposed at only one of the outer substrate surface and the feature surface, and is positioned with respect to the exterior surface of the cover to form a predetermined design thereon. The mechanoluminescent material emits visible light in response to an externally-applied stress, and, as such, illuminates the predetermined design on the exterior surface of the cover.

The above features and advantages, and other features and advantages, of the present teachings are readily apparent from the following detailed description of some of the best modes and other embodiments for carrying out the present teachings, as defined in the appended claims, when taken in connection with the accompanying drawings.

DETAILED DESCRIPTION

Figure 1:
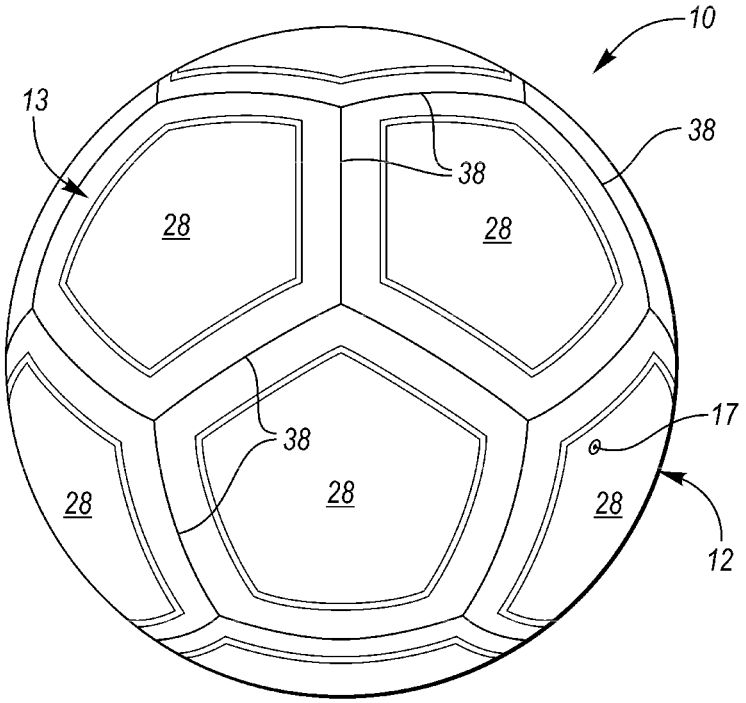
FIG. 1 is a schematic perspective view of an example inflatable sports ball.

While the present disclosure may be described with respect to specific applications or industries, those skilled in the art will recognize the broader applicability of the disclosure. Those having ordinary skill in the art will recognize that terms such as "above," "below," "upward," "downward," etc., are used descriptively of the figures, and do not represent limitations on the scope of the disclosure, as defined by the appended claims. Any numerical designations, such as "first" or "second" are illustrative only and are not intended to limit the scope of the disclosure in any way.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

The terms "A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

The following discussion and accompanying figures disclose various sports ball configurations and methods relating to manufacturing of the sport balls. Although the sports ball is depicted as a soccer ball in the associated Figures, concepts associated with the configurations and methods may be applied to various types of inflatable sport balls, such as basketballs, footballs (for either American football or rugby), volleyballs, water polo balls, etc. and a variety of non-inflatable sports balls, such as baseballs and softballs, may also incorporate concepts discussed herein.

Referring to the drawings, wherein like reference numerals refer to like components throughout the several views, an inflatable sports ball 10 is provided.

Figure 2:
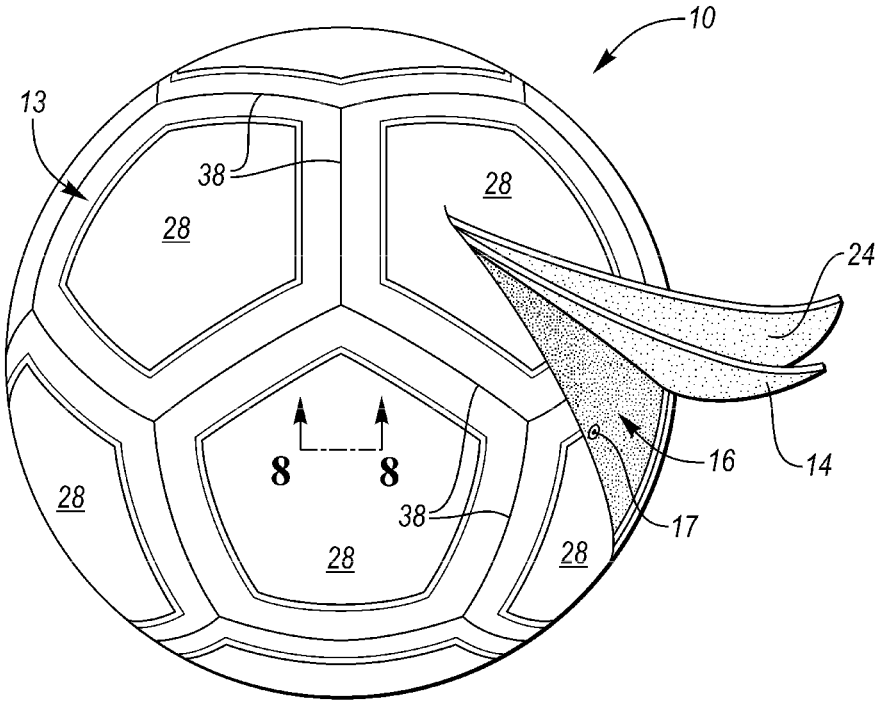
FIG. 2 is a schematic perspective view of an example inflatable sports ball, wherein the ball includes an interior bladder and a cover, the cover including an outer substrate and an intermediate structure.
Figure 3:
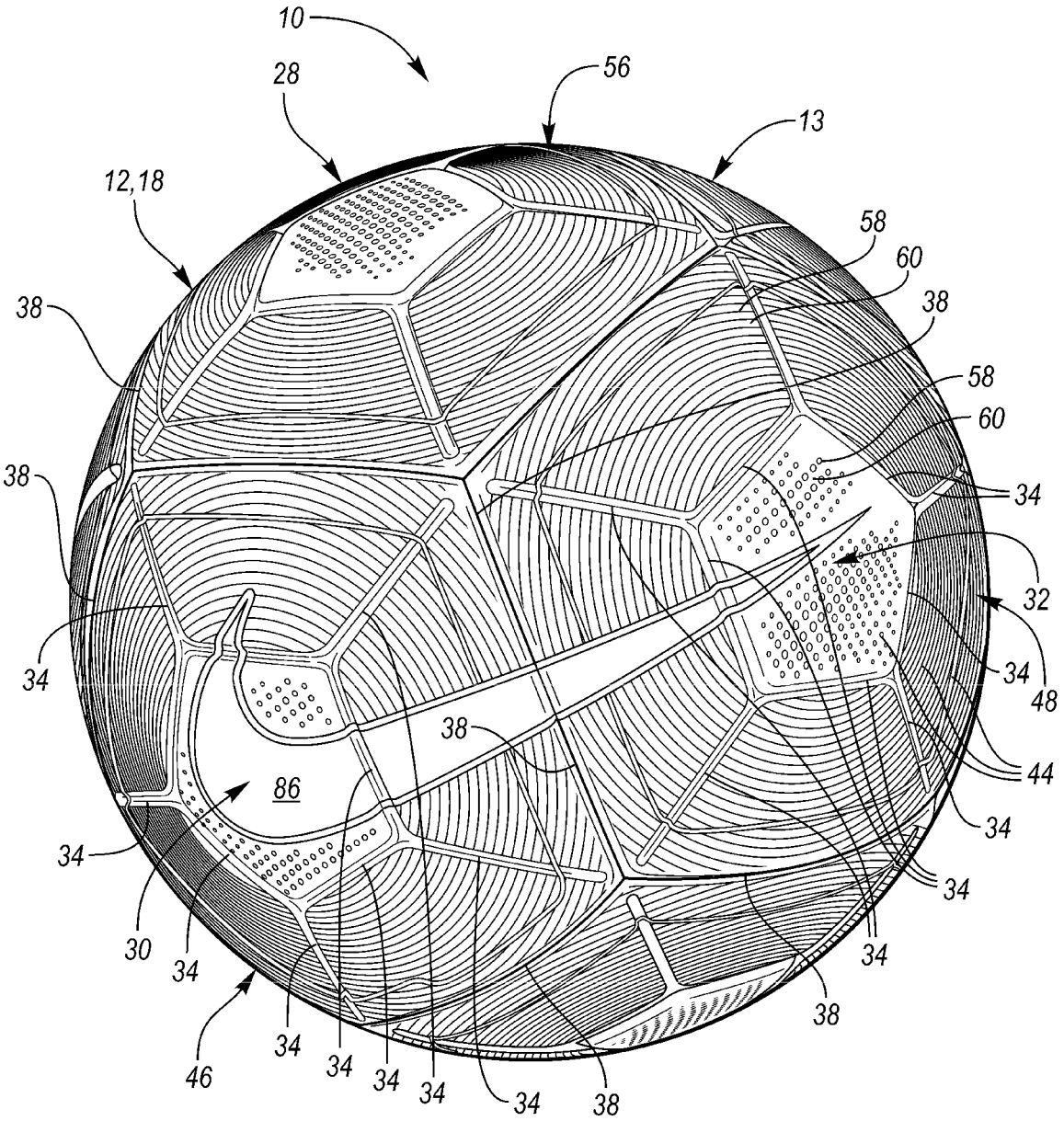
FIG. 3 is a schematic perspective view of an example inflatable sports ball, wherein the cover includes a plurality of protrusions, a plurality of land areas, and a plurality of indentations. The protrusions, land areas, and indentations cooperate to define a topographical design on the exterior surface of the inflatable sports ball.

As shown in FIGS. 1-3, the sports ball 10 may be an inflatable sports ball such as a soccer ball or the like or a non-inflatable sports ball 10 such as a softball or the like. A sports ball 10 having the general configuration of a soccer ball is depicted in FIGS. 1-3. As shown in FIGS. 1 and 2, the sports ball 10 may have a layered structure including a cover 12 and an interior 16 (FIGS. 2 and 5-8). The cover 12 forms an exterior portion of the sports ball 10. The interior 16 forms an interior portion of sports ball 10.

In a non-inflatable example configuration of the sports ball 10, the interior 16 may be one of a solid mass and hollow mass, fixed in size. In an inflatable example configuration of the sports ball 10, the interior 16 may be an interior bladder (FIGS. 2 and 5-8). In the inflatable example configuration, in order to facilitate inflation (i.e., fill the interior with pressurized air), the interior 16 generally includes a valved opening 17 that extends through the cover 12, thereby being accessible from an outer substrate surface 18 of the sports ball 10. Upon inflation, the bladder 16 is pressurized and the pressurization induces the outer substrate surface 18 to be a substantially spherical surface as the sports ball 10 takes on a substantially spherical shape. More particularly, pressure within bladder 16 causes the bladder 16 to place an outward force upon the cover 12 on an inner substrate surface 20.

The cover 12 forms an exterior portion of the sports ball 10 and has an exterior surface 13. The term cover 12 is meant to include any layer of the sports ball 10, which surrounds the interior 16. Thus, the cover 12 may include both the outermost layer and also any intermediate layers, which are disposed between the interior 16 and the exterior surface 13. As shown in FIGS. 2 and 5-8, the cover 12 may be composed as a layered structure including an outer substrate 24 and an intermediate structure 14 located interior to the outer substrate 24 between the outer substrate 24 and the interior 16. The cover 12 further includes the outer substrate surface 18, defined by the outer substrate 24, the inner substrate surface 20 opposite the outer substrate surface 18, and a feature surface 21 radially spaced apart from the outer substrate surface 18, in a direction opposite the inner substrate surface 20. The outer substrate surface 18 and the feature surface 21 cooperate to define the exterior surface 13 of the sports ball 10. The inner substrate surface 20 may be disposed adjacent to the ball interior 16.

In some embodiments, the outer substrate 24 may be a composed of a polymeric material, a polymer foam material, or the like. Examples of suitable polymer materials include, but are not limited to, polyurethane, polyvinylchloride, polyamide, polyester, polypropylene, polyolefin, and the like.

The intermediate structure 14 may include a first intermediate cover layer 26 and a second intermediate cover layer 22. The first intermediate cover layer 26 is positioned between the outer substrate 24 and the second intermediate cover layer 22. The second intermediate cover layer 22 is positioned between the first intermediate cover layer 26 and the interior bladder 16. The second intermediate cover layer 22 may include the inner substrate surface 20, wherein the inner substrate surface 20 is positioned adjacent to the ball interior 16.

The respective cover layers 22, 26 of the intermediate structure 14 may be composed of a polymeric material, a polymer foam material, a foam material, textiles, or the like. Examples of suitable polymer materials include, but are not limited to, polyurethane, polyvinylchloride, polyamide, polyester, polypropylene, polyolefin, and the like. Examples of suitable polymer foam materials include, but are not limited to, polyurethane, ethylvinylacetate, and the like. Examples of suitable textile materials include, but are not limited to, a woven or knit textile formed from polyester, cotton, nylon, rayon, silk, spandex, or a variety of other materials. A textile material may also include multiple materials, such as a polyester and cotton blend. The intermediate structure 14 may further provide a softened feel to the sports ball, impart energy return, and restrict expansion of bladder 16, in an inflatable sports ball example.

Figure 8:
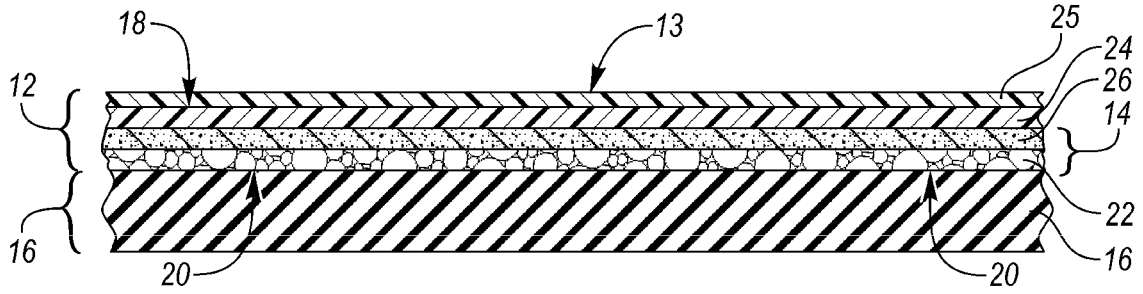
FIG. 8 is an example cross-section view of the cover taken along line 8-8 in FIG. 2.
Figure 9:
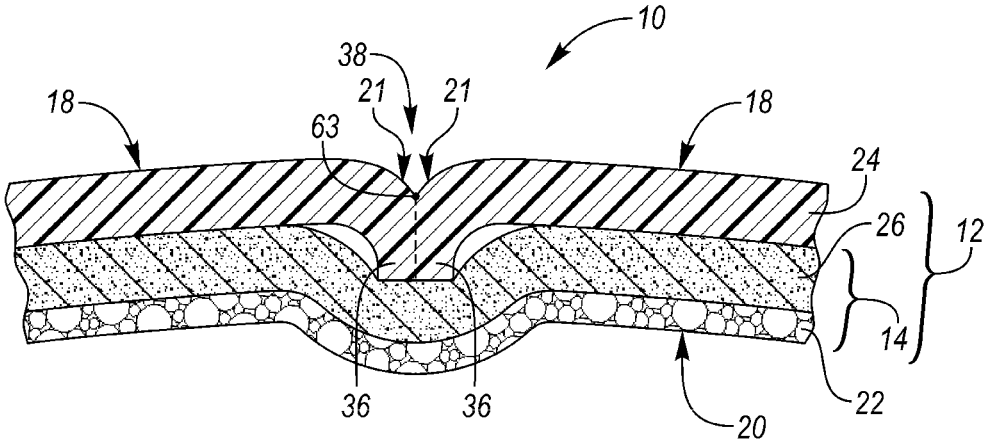
FIG. 9 is an enlarged, schematic, example cross-section of an indentation, wherein the indentation is defined as a seam.
Figure 10A:
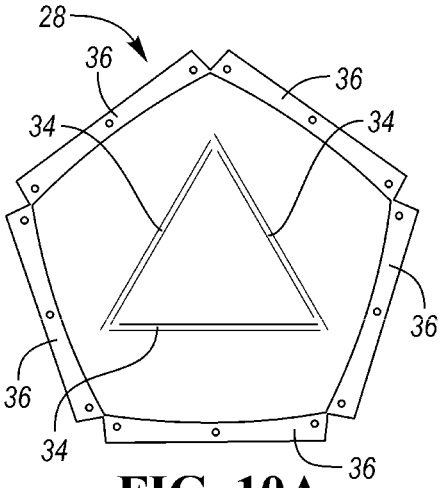
FIG. 10A is an example schematic plan view of an example pseudo-seam panel arrangement shown on an example panel.
Figure 10B:
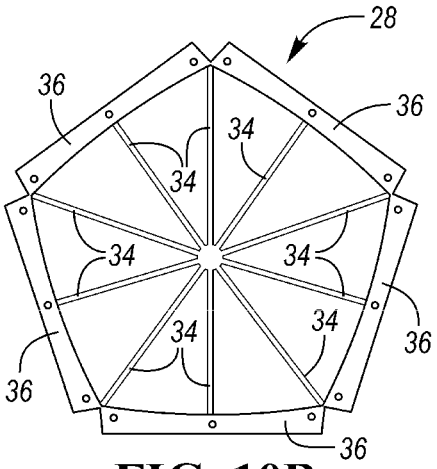
FIG. 10B is an example schematic plan view of another example pseudo-seam panel arrangement shown on an example panel.
Figure 10C:
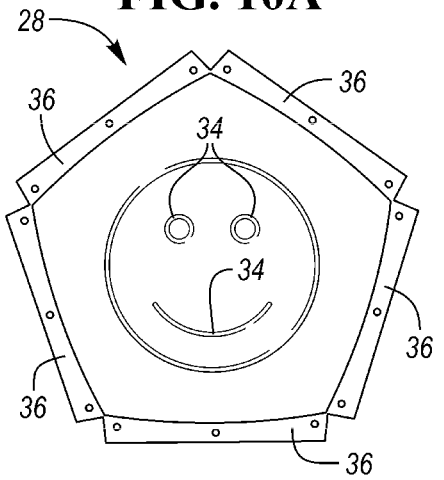
FIG. 10C is an example schematic plan view of another example pseudo-seam panel arrangement shown on an example panel.
Figure 10D:
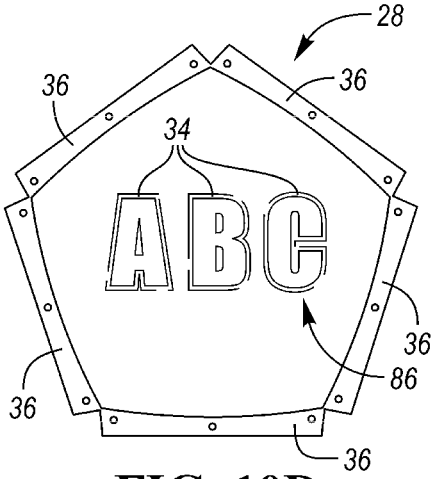
FIG. 10D is an example schematic plan view of another example pseudo-seam panel arrangement shown on an example panel.
Figure 10E:
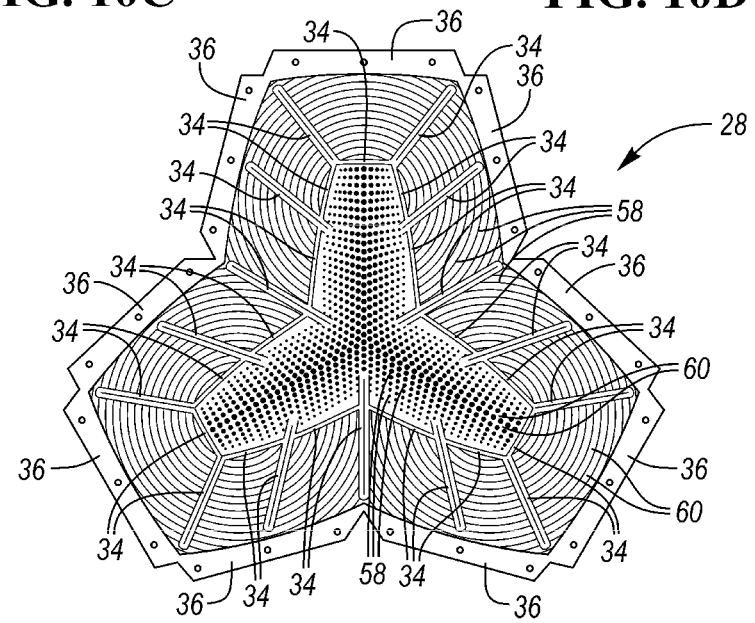
FIG. 10E is an example schematic plan view of an example panel having an example pseudo-seam panel arrangement and an example protrusion panel arrangement formed thereon.

As shown in FIG. 8, the cover may further include an external surface layer 25 disposed upon the outer substrate surface 18 of the cover 12. The external surface layer 25 may be a film that includes a pigment or a graphic thereon. The external surface layer 25 may also be an outer film or clear coat having weather resistant properties. The external surface layer 25 may be a polyurethane film or the like. The external surface layer 25 may be bonded to the outer substrate surface 18 via a bonding material.

As shown in FIGS. 1-4, 10A-10E, and 12A-12B, the cover 12 may be generally formed by a plurality panels 28, wherein each panel 28 has a respective panel surface that defines a portion of the outer substrate surface 18. The plurality of panels 28 includes at least a first panel 30 having a first panel surface 40 and a second panel 32 having a second panel surface 42. The respective panels 28 may be coupled together along abutting edge areas 36 (FIGS. 4, 10E, and 12A-12B) via at least one seam 38 (FIGS. 1-4, and 12A-12B). The panels 28 may be coupled along the abutting edge areas 36 by the seam 38 with stitching, bonding, welding, adhesives, or another suitable coupling method.

The cover 12, when part of an example soccer ball 10, may include various numbers of panels 28, such as the conventional eleven (11) panels or any other number of panels 28. The cover 12 may also exhibit a substantially uniform or unbroken configuration that does not include panels 28 joined at abutting edge areas 36 via seams 38, or includes fewer panels 28. In configurations, wherein a reduced number of panels are present or the ball 10 exhibits a substantially uniform or unbroken configuration, indentations in the form of pseudo seams 34 may be positioned in areas of the cover 12 where traditional seams 38 are present to impart the appearance of panels 28.

A mechanoluminescent material that emits visible light or illuminates in response to an externally-applied stress or mechanical stimulus may be selectively positioned on the sports ball 10, in order to create an exterior design, highlight one or more surface features of the ball, and/or to provide a unique visual effect when the exterior surface 13 of the ball 10 is acted on by a mechanical stimulus, e.g., the ball 10 is struck by another object, such as a player's foot, a goal keeper, a goal post, or another external article. The luminescence generated by the mecholuminescent material in response to an externally-applied stress, e.g., contact with a player's foot, a goal keeper, or a goal post, etc. is useful to visually trace the ball in motion. Spectators and players alike, desire the ability to track sports balls 10, such as soccer balls, particularly in low light conditions or during a television viewing experience when the camera angle is further removed from the sports ball 10. For example, in low light conditions it can be difficult to observe a sports ball 10 in flight after it has been struck by the player's foot. A sports ball 10 having mecholuminescent features, may be more easily tracked in motion, and may be particularly beneficial during penalty kick situations in soccer games, especially in low light conditions.

In one example embodiment, a mechanoluminescent material may be embedded in a portion of the cover 12. The mechanoluminescent material may be embedded in one of the outer substrate 24, the external surface layer 25 disposed on the outer substrate surface 18, and a surface texture 44 disposed on the outer substrate surface 18. In a preferred embodiment, the mechanoluminescent material is disposed at only one of the outer substrate surface 18 and the feature surface 21 in order to highlight one or more surface features or designs and/or to provide a unique visual effect. Said another way, the mechanoluminescent material is viewable on only a portion of the exterior surface 13 of the sports ball 10, wherein a portion is less than the entire exterior surface 13.

The term mechanoluminescent material used herein is defined as a material that emits light in response to an externally-applied stress. The emission of light from the mechanoluminescent material does not result from heat, as it is a form of cold-body radiation. Rather, mechanoluminescent material emits light in response to an externally-applied stress, such as an external mechanical stimuli (e.g., compression, displacement, friction, impact, etc.), on the exterior surface 13 of the sports ball 10.

The externally-applied stress may be an external mechanical stimuli (e.g., compression, displacement, friction, impact, etc.), on the exterior surface 13 of the sports ball 10. The mechanical stimuli may be a strike upon the exterior surface 13 of the ball 10 with a player's foot or another external article. The mechanoluminescence (illumination in response to an externally-applied stress) dissipates or fades over a time period, and the exterior surface 13 of the sports ball 10 eventually returns to its original coloration. When the ball 10 is subjected to another or subsequent externally-applied stress, the mechanoluminescence is generated again as an independent luminescence event.

In some example embodiments, the mechanoluminescent material may be provided in or as a constituent of one or more of the following: paints, inks, resins, pigments, dyes, coatings, curing catalysts, ultraviolet absorbers, photostabilizers, antistatic agents, flame retardants, photopolymerization initiators, and the like.

The mechanoluminescent material may include one of a piezoluminescent material and a triboluminescent material. In such an example, the mechanoluminescent material emits visible light (illuminates), when the exterior surface 13 of the sports ball 10 is acted on by a mechanical stimulus, e.g., the ball 10 is struck by another object, such as a player's foot, a goal keeper, a goal post, or another external article.

In an example embodiment wherein the mechanoluminescent material is a triboluminescent material, luminescence is generated through the breaking of chemical bonds in the triboluminescent material when it is pulled apart, ripped, scratched, crushed, or rubbed during its interaction with the external mechanical stimulus.

In an example embodiment wherein the mechanoluminescent material is a piezoluminescent material, luminescence is generated when the piezoluminescent material is deformed during its interaction with the external mechanical stimulus.

In another example embodiment, the mechanoluminescent material may comprise a crystalline material. The crystalline material can include an aluminate material. The aluminate can include an alpha-alumina. Alternatively or additionally, the aluminate can be an intermediate alumina other than alpha-alumina or a precursor thereof such as, for example, aluminum hydroxide. The aluminate material can be a material containing 90 mol % or less of alpha-alumina. The aluminate material can be a strontium aluminate material.

The strontium aluminate can be represented by $Sr_xAl_yO_z$, wherein 0<x, 0<y, and 0<z. Non-limiting examples of the strontium aluminate include compounds such as $SrAl_2O_4$, $SrAl_4O_7$, $Sr_4Al_4O_{25}$, $SrAl_{12}O_{19}$, and $Sr_3Al_2O_6$. The mechanoluminescent material comprising an aluminate material can further comprise europium (Eu) alone or in combination of at least one element selected from the group consisting of neodymium (Nd), dysprosium (Dy), and holmium (Ho). In such cases, the Eu may act as an activator, and the Nd, Dy or Ho may act as a co-activator. The mechanoluminescent material can include 0.0001 to 0.01 mole, or 0.0005 to 0.005 mole of Eu per mole of aluminate (e.g., per mole of strontium aluminate). The mechanoluminescent material can include 0.0001 to 0.01 mole, or 0.0005 to 0.005 mole total of the at least one element selected from the group consisting of Nd, Dy and Ho per mole of aluminate. The example mechanoluminescent material, including europium-activated strontium aluminate, can exhibit improved mechanoluminescence by adjusting the amounts of the activator (Eu) and the co-activator(s) (e.g., Nd, Dy, and Ho).

The mechanoluminescent material may generally be physically and chemically stable under various conditions. When an externally-applied stress or mechanical stimulus is applied to the mechanoluminescent material, the mechanoluminescent material is excited and emits light. The externally-applied stress or mechanical stimulus, may include, for example, striking the mechanoluminescent material with an external object, such as a player's foot, a goal keeper, a goal post, or another external article.

Reference is made to United States Patent Application Publication Nos. 2016/0053172 and 2017/0002264 for a detailed discussion of example mechanoluminescent materials, containing europium-activated strontium aluminate, and their production, and, as such, United States Patent Application Publication Nos. 2016/0053172 and 2017/0002264 are hereby entirely incorporated by reference herein.

The amount of generated luminescence may vary depending upon the strength of the force or externally-applied stress exerted on the exterior surface 13 of the ball 10. For example, the amount of generated luminescence may be relatively low or non-existent when a weak force or external stress is applied to the exterior surface 13 of the ball 10, such as the frictional force between the ball 10 and a playing field, when the ball is in motion on the ground. The amount of generated luminescence may be greater, when a larger or more powerful externally-applied stress is exerted upon the mechnoluminescent material, such as a player's foot striking the exterior surface 13 of the ball 10, a portion of a goal keeper blocking the ball 10, or when the ball 10 strikes a goal post.

As detailed herein above, the luminescence generated by the mecholuminescent material in response to an externally-applied stress, is useful to visually trace the ball in motion, particularly in low light conditions or during a television viewing experience when the camera angle is further removed from the sports ball 10. For example, in low light conditions it can be difficult to observe a sports ball 10 in flight after it has been struck by the player's foot. A sports ball 10 having mecholuminescent features, may be more easily tracked in motion, and may be particularly beneficial during penalty kick situations in soccer games, especially in low light conditions.

As shown in FIGS. 3-12B, the feature surface 21 may include at least one topographic feature, such as a protrusion 58, indentation 38, 34, or the like. As illustrated throughout FIGS. 3-7C, the feature surface 21 includes at least one protrusion 58. The at least one protrusion 58 is disposed upon and additively applied to the outer substrate surface 18 of the cover 12. The at least one protrusion 58 may be defined as a plurality of protrusions 58 that are part of a surface texture 44 disposed on the outer substrate surface 18 of the cover 12. The protrusions 58 may form decorative or aesthetic arrangements or designs 46, 48, 56 upon the sports ball 10, display branding of the sports ball 10, via a logo 86 contained therein, and may further be applied in such an orientation as to optimize grip at the point of contact with the user's hand and/or foot, or to improve aerodynamics during flight.

The protrusions 58 may be disposed on a small portion of the outer substrate surface 18, on a single panel surface 40, 42 (FIG. 4), on a select group of panel surfaces 40, 42, or upon a majority of the outer substrate surface 18 (FIG. 3).

Each of the protrusions 58, defined by the feature surface 21, extend from the outer substrate surface 18. As shown in FIGS. 5-7C, each of the plurality of the protrusions 58 has a terminus 62 that is disposed on the feature surface 21 and is radially spaced apart from the outer substrate surface 18 by a height 64 that is greater than about 0.05 millimeters (mm). Referring to FIGS. 7B-7C, the protrusions 58 may further include a first sidewall 72 and a second sidewall 74.

In one example embodiment, the height 64 may be from about 0.07 millimeters (mm) to about 0.15 millimeters (mm). In another example, the height 64 is about 0.11 millimeters (mm). In such examples, it is beneficial for the height 64 to be at least 0.05 millimeters (mm) and less than 0.15 millimeters (mm) in order to enhance playability of the ball 10. Protrusions 58 having heights 64 in the aforementioned range allow for visibility of the respective designs or panel arrangements 46, 48 and an overall topographical design 56, while also exhibiting a desired grip or contact between a user and/or player's hand or foot and the exterior surface 13 of the ball 10, all while still allowing the ball 10 to maintain desired aerodynamic and flight characteristics.

In some example embodiments, each of the plurality of protrusions 58 may be formed from a dimensional ink. The dimensional ink may be a resin-based ink, a puff ink, a water-based ink, a water-based silicone ink, or the like suitable for additive manufacturing and/or dimensional printing via an additive manufacturing process. More particularly, the dimensional ink may be a hybrid ink containing a polyurethane resin component and a puff ink component. The dimensional ink may also include an organic compound such as Cyclohexanon $(CH_2)_5CO$. The dimensional ink may also include a Polyurethane powder to add texture to the ink. The dimensional ink may be clear in color, such that the dimensional ink is transparent or translucent. The dimensional ink may also be pigmented to a predetermined coloration. The mechanoluminescent material may be embedded in the dimensional ink.

In one example embodiment, the dimensional ink may include a polyurethane resin component in a concentration or percentage-based amount of from about 15% to about 25%, a puff ink component in a concentration or percentage-based amount of less than about 7%, and a Cyclohexanon $(CH_2)_5CO$ component in a concentration or percentage-based amount of from about 65% to about 80%. In such an example, the viscosity of the dimensional ink may be from about 300 decipascal second (dpa·s) to about 400 dpa·s, the percentage of solid content may be from about 25% to about 30%, and the Volatile Organic Compounds (VOCs) may be from about 710 g/L to about 770 g/L.

Figure 7A:
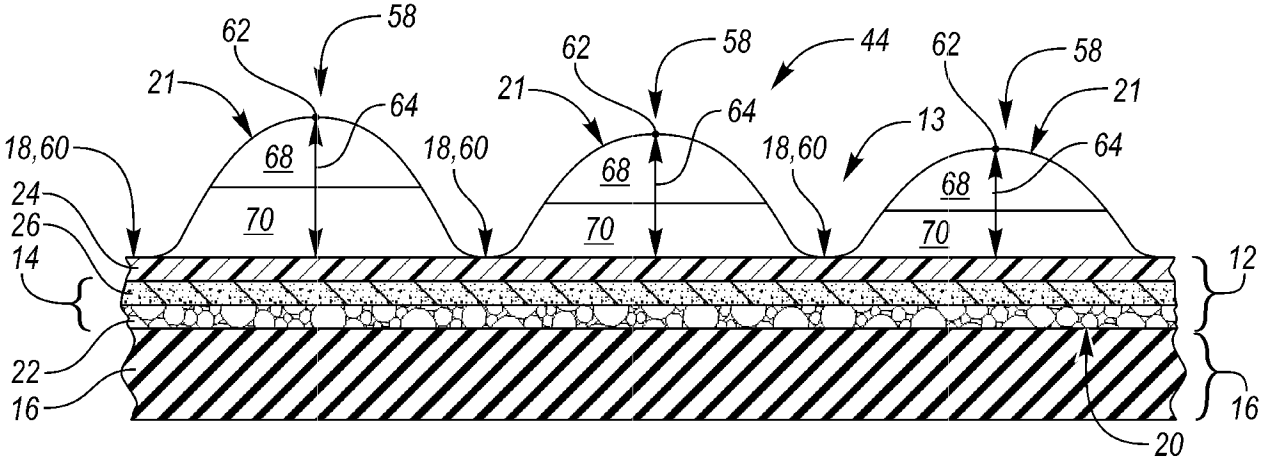
FIG. 7A is an enlarged, schematic, example cross-section view of a portion of FIG. 6.
Figure 7B:
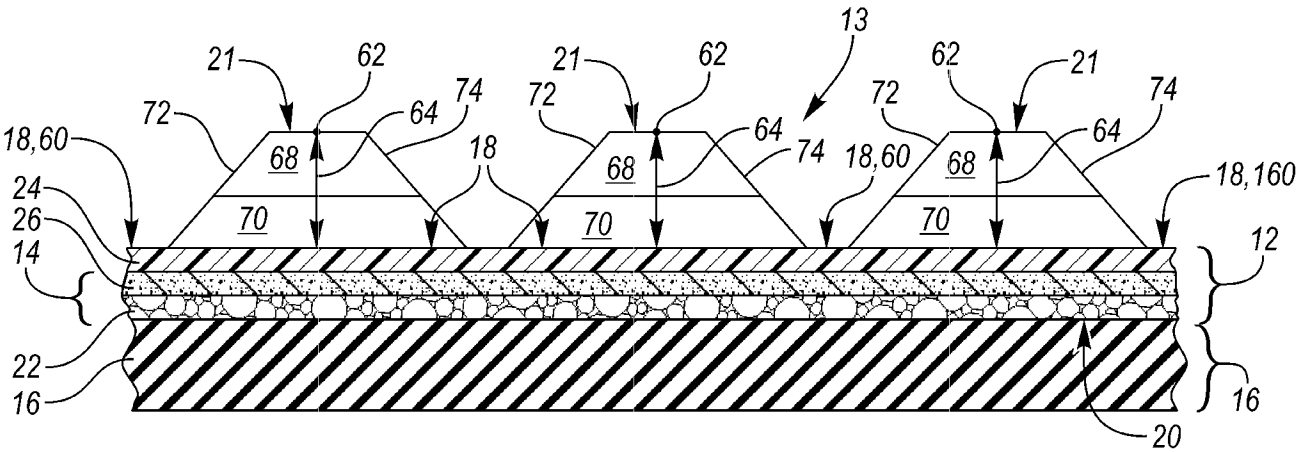
FIG. 7B is an enlarged, schematic, example cross-section of an example panel.
Figure 7C:
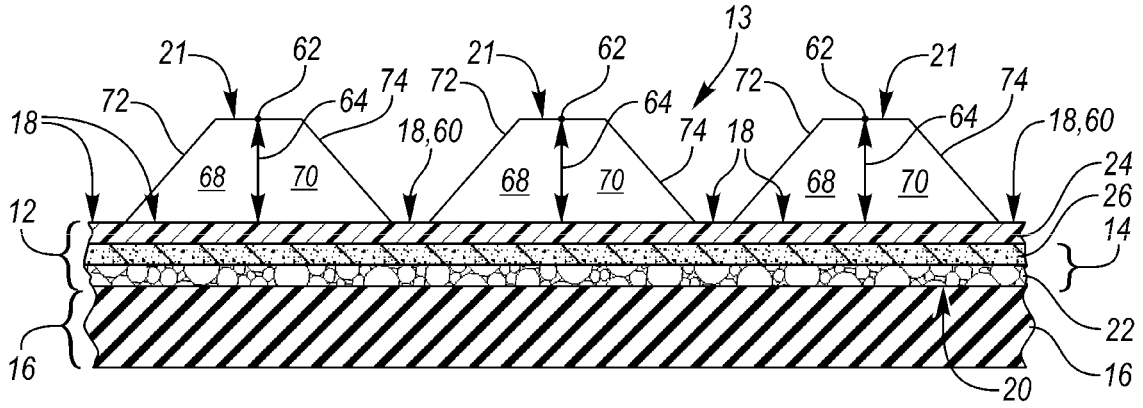
FIG. 7C is another enlarged, schematic, example cross-section of an example panel.

As shown in FIGS. 7A-7C each protrusion 58 may be composed of a single portion or sector of dimensional ink that spans the entire height 64 from the outer substrate surface 18 to the terminus 62. Each protrusion 58 may, alternatively, be composed of a plurality of portions or sectors 68, 70, which together span the entire height 64 from the outer substrate surface 18 to the terminus 62.

In one example embodiment, as shown in FIGS. 7A and 7B, the plurality of sectors 68, 70 may be embodied as a plurality of layers 68, 70. In such an example, each of the plurality of sectors or layers 68, 70 may be composed of a dimensional ink of a particular color different than the remaining layers, the layers may repeat a color pattern, e.g., alternating colors, or the plurality of layers may all be composed of a dimensional ink of the same color, for example a translucent or transparent dimensional ink. In the same example embodiment, wherein the plurality of sectors 68, 70 is embodied as a plurality of layers 68, 70, the plurality of layers may include a first layer 68 and a second layer 70. The second sector or layer 70 may be composed of the dimensional ink, and may be positioned between the outer substrate surface 18 and the first sector or layer 68. The first sector 68 may be composed of the dimensional ink, and may be positioned between the terminus 62 and the second sector 70.

In another example embodiment, as shown in FIG. 7C, The plurality of sectors 68, 70 may be embodied as two adjacent sectors 68, 70, which each span the entire height 64 from the outer substrate surface 18 to the terminus 62. For example, in such an embodiment, the first sector 68 may compose one side of the protrusion 58, being defined between the outer substrate surface 18, the terminus 62, and a feature surface 21 embodied as a first sidewall 72. In the same example, the second sector 70 may compose another side of the protrusion 58, being defined between the outer substrate surface 18, the terminus 62, and a feature surface 21 embodied as a second sidewall 74.

In one example, the mechanoluminescent material may be disposed at the feature surface 21 and embedded in the dimensional ink of at least one of the plurality of sectors 68, 70 of the respective protrusion 58. In one example, the mechanoluminescent material may be embedded in the dimensional ink of each of the first sector 68 and the second sector 70. In another example, shown in FIGS. 7A-7C, the mechanoluminescent material may be embedded in the dimensional ink of the first sector 68. In yet, another example, shown by example in FIG. 7C, the mechanoluminescent material may be embedded in the dimensional ink of the second sector 70.

The cover 12 may further comprise a plurality of land areas 60 that are defined by the outer substrate surface 18. Each land area 60 may be disposed between a plurality of protrusions 58, and likewise, each protrusion 58 may be positioned between a plurality of land areas 60. Said another way, the plurality of protrusions 58 and the plurality of land areas 60 define a surface profile 50, 52 (FIGS. 5-7C) that includes an alternating and repeating series of the land areas 60 and the protrusions 58.

In another example, the mechanoluminescent material may be disposed at the outer substrate surface 18 and embedded in one of the outer substrate 24 and the external surface layer 25. In such an example, layer containing the mechanoluminescent material, e.g., one of the outer substrate layer 24 and the external surface layer 25, may be a polyurethane skin, having a thickness of about 0.5 millimeters (mm) or less. In the same example, the mechanoluminescent material may be disposed at the land areas 60.

The protrusions 58 may be additively applied to the cover 12, and positioned on a respective panel surface 40, 42 in a predefined protrusion panel arrangement 46, 48 (FIG. 4), via an additive manufacturing process. The predefined protrusion panel arrangement 46, 48 may cover a small portion of the respective panel surface 40, 42 and/or a majority of the respective panel surface 40, 42. Further, the predefined protrusion panel arrangement 46, 48 may vary by panel 28, 30, 32 and is further customizable by panel 28, 30, 32, e.g., each panel may include a unique design or predefined protrusion panel arrangement 46, 48. Said another way, the protrusions 58 and the surface texture 44 formed thereby need not be uniform across the majority of the outer substrate surface 18 or uniform across an entire panel surface 40, 42.

Figure 4:
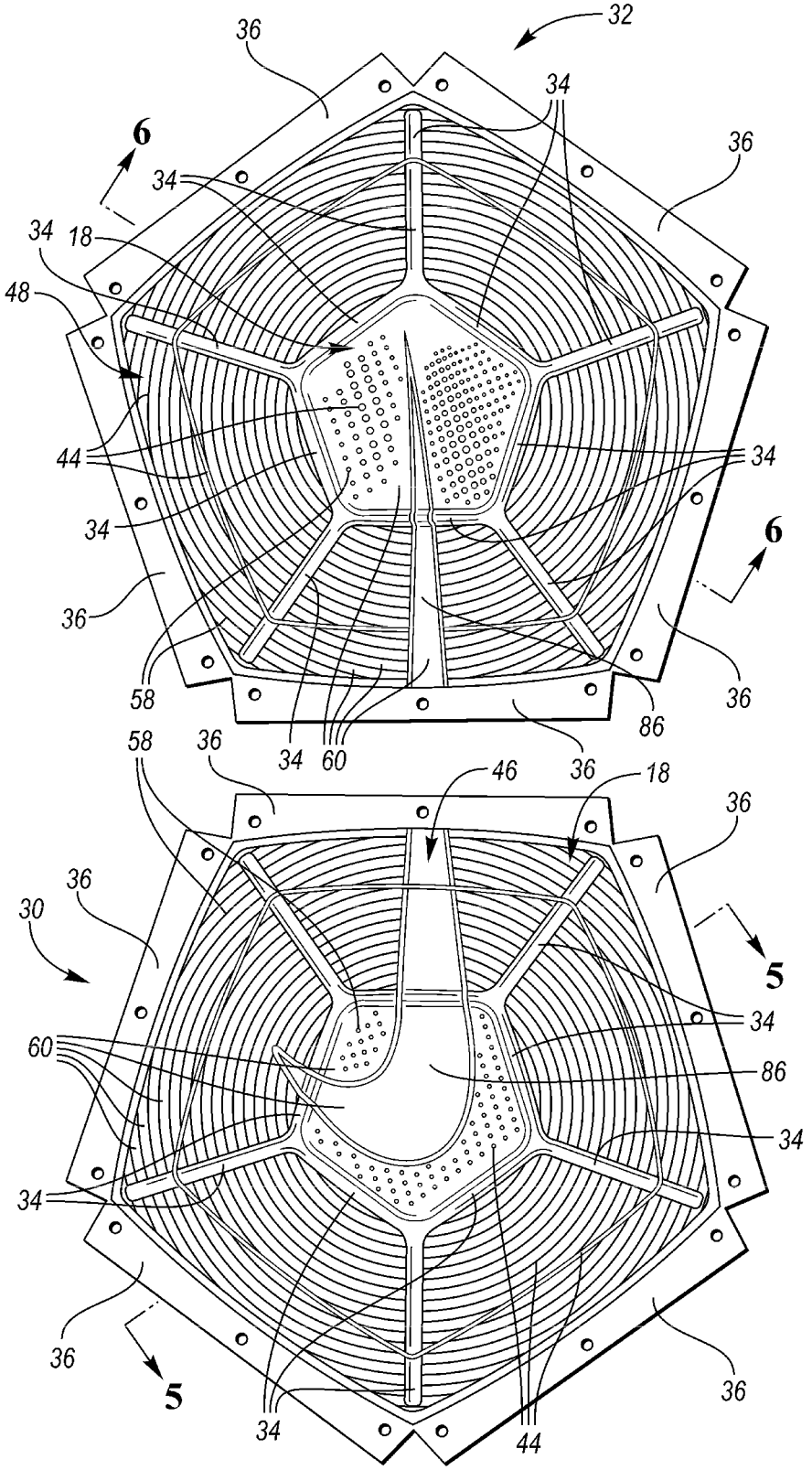
FIG. 4 is a schematic perspective view of a first panel and a second panel, wherein the plurality of protrusions is arranged in a first protrusion panel arrangement on the first panel and in a second protrusion panel arrangement on the second panel, and wherein the plurality of indentations is arranged in a first pseudo seam panel arrangement on the first panel and in a second pseudo seam panel arrangement on the second panel.
Figure 5:
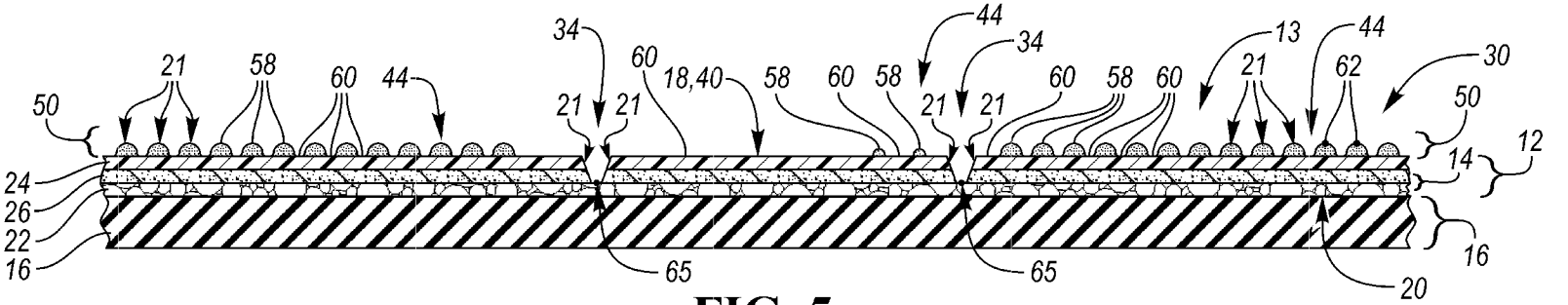
FIG. 5 is a schematic cross-section view of the first panel taken along line 5-5 in FIG. 4.
Figure 6:
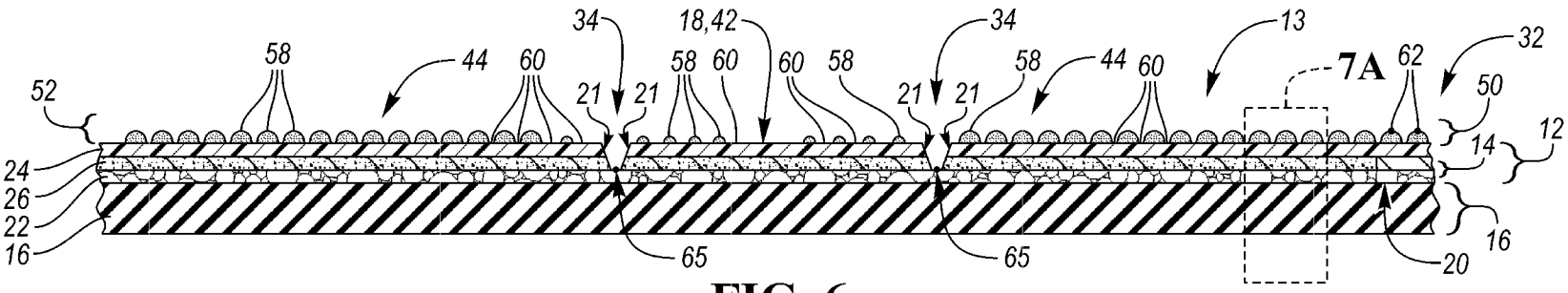
FIG. 6 is a schematic cross-section view of the second panel taken along line 6-6 in FIG. 4.

In one example, shown in FIG. 4 the protrusions 58 may be positioned on the first panel surface 40 of the first panel 30 in a first predefined protrusion panel arrangement 46, which results in a first surface profile 50 (FIG. 5). The protrusions 58 may be positioned on the second panel surface 42 of the second panel 32 in a second predefined protrusion panel arrangement 48, which results in a second surface profile 52 (FIG. 6). As shown in FIGS. 4-6, the first predefined protrusion panel arrangement 46 may be different than the second predefined protrusion panel arrangement 48, and the first surface profile 50 (FIG. 5) may be different than the second surface profile 52 (FIG. 6).

Referring to FIGS. 3, 5, 6, 9, and 11A-11G, in some embodiments, the feature surface 21 may further include at least one indentation 34, 38. In such an example embodiment, the mechanoluminescent material may be disposed in the at least one indentation 34, 38.

Figure 12A:
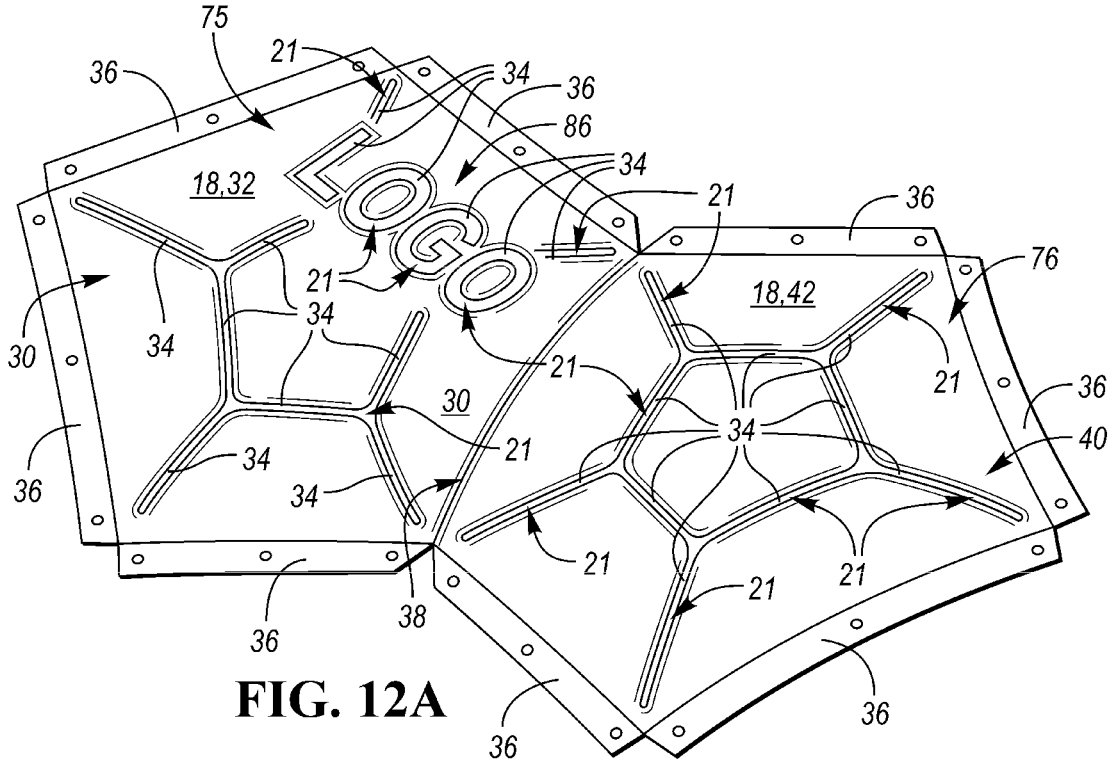
FIG. 12A is an example schematic, perspective view of a first panel and a second panel, wherein the plurality of indentations is arranged in an example first pseudo seam panel arrangement on the first panel and in an example second pseudo seam panel arrangement on the second panel.
Figure 12B:
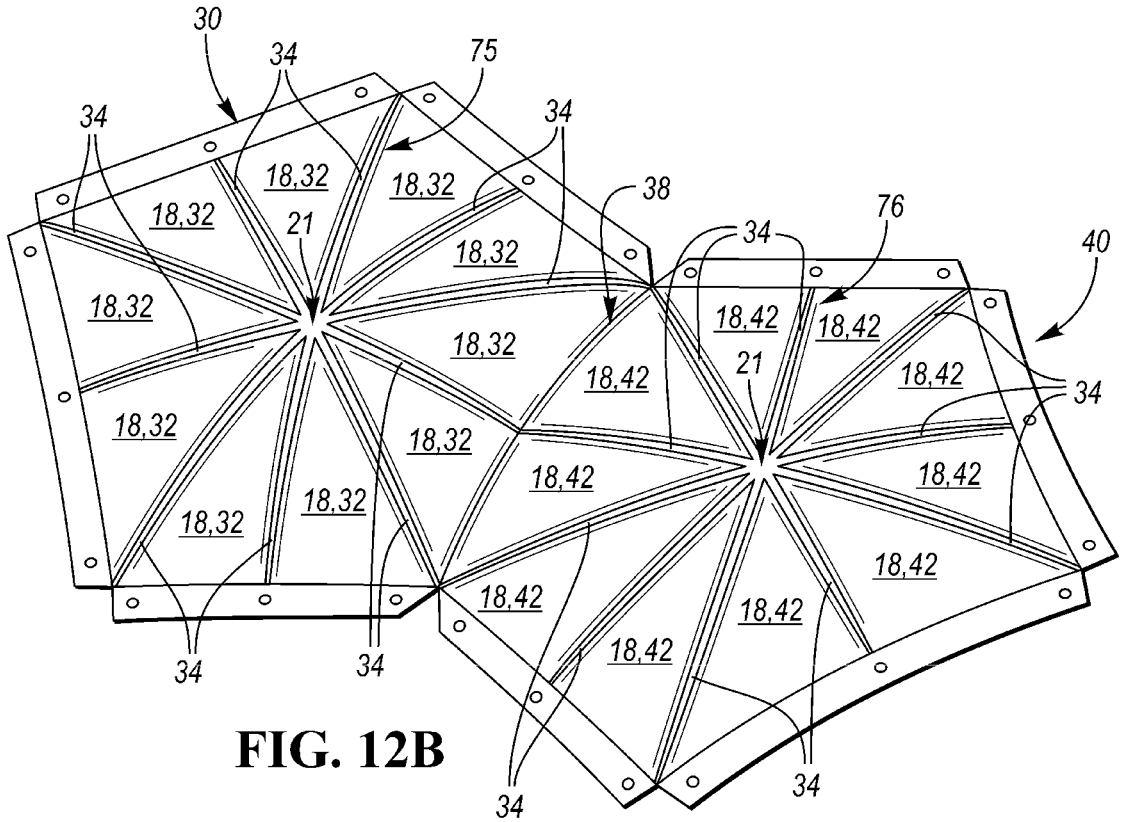
FIG. 12B is another example schematic, perspective view of a first panel and a second panel, wherein the plurality of indentations is arranged in another example first pseudo seam panel arrangement on the first panel and in another example second pseudo seam panel arrangement on the second panel.

The at least one indentation 34, 38 may be defined as at least one seam 38, wherein the at least one seam 38 is configured to couple together respective panels 28, 30, 32 along abutting edge areas 36 (FIGS. 4 and 12A-12B). Panels 28, 30, 32 may be joined at the at least one seam 38 via at least one of stitching (hand or machine stitching), an adhesive, bonding, welding, or another suitable coupling process. As utilized herein, the term "welding" or variants thereof (such as "thermal bonding") is defined as a technique for securing two elements to one another that involves a softening or melting of a polymer material within at least one of the elements such that the materials of the elements are secured to each other when cooled. Similarly, the term "weld" or variants thereof (e.g., "thermal bond") is defined as the bond, link, or structure that joins two elements through a process that involves a softening or melting of a polymer material within at least one of the elements such that the materials of the elements are secured to each other when cooled. An example of welded seams 38 is disclosed in U.S. Pat. No. 8,608,599 to Raynak, et al., which is hereby entirely incorporated herein by reference.

The at least one seam 38 has a terminus 63 disposed on the feature surface 21, such that the terminus 63 is radially-spaced apart from the outer substrate surface 18 (FIG. 9) in a direction toward the inner substrate surface 20. The mechanoluminescent material may be embedded in one of the outer substrate 24 and the external surface layer 25 and disposed at the feature surface 21 in the at least one seam 38. The mechanoluminescent material may be disposed in all seams 38 present on the sports ball 10, or the mechanoluminescent material may be selectively disposed in one or more select seams 38 of the sports ball 10.

The at least one indentation 34, 38 may be defined as at least one pseudo seam 34. The term pseudo seam 34 as used herein is defined as an indentation in the cover 12, which is defined by the feature surface 21 and is not a seam 38. Pseudo seams 34 may impart various advantages to ball 10. For example, pseudo seams 34 may enhance the aerodynamics of ball 10 or provide an individual with greater grip or control over ball 10 during play, e.g., during kicking, dribbling, or passing.

Pseudo seams 34 may be formed in the outer substrate 24 via a variety of manufacturing processes including, but not limited to, debossing. Examples of a manufacturing process for forming pseudo seams 34 are disclosed in U.S. Pat. No. 9,370,693 to Berggren, et al., which is hereby entirely incorporated by reference herein.

Referring to FIGS. 11A-11F, pseudo seams 34 are formed in the cover 12 and extend toward the interior 16. The intermediate structure 14 is positioned between outer substrate 24 and the interior bladder 16. The outer substrate 24 is bonded to the intermediate structure 14 at the respective pseudo seam 34. More particularly, the outer substrate 24 may be bonded directly to the second intermediate cover layer 22 at the pseudo seam 34 (FIGS. 11A-C and 11E-G).

The at least one pseudo seam 34 may include an exterior indentation 82 and an interior indentation 84. The exterior indentation 82 is defined by the feature surface 21 and has a terminus 65 disposed on the feature surface 21, such that the terminus 65 is radially-spaced apart from the outer substrate surface 18 by a depth 67 that is greater than about 0.05 millimeters (mm).

The mechanoluminescent material may be disposed at the feature surface 21 in the at least one pseudo seam 34. More particularly, the mechanoluminescent material may be disposed within the exterior indentation 82 of the respective pseudo seam 34. The mechanoluminescent material may be embedded in one of the outer substrate 24 and the external surface layer 25 and disposed at the feature surface 21 in the exterior indentation 82 of the at least one pseudo seam 34. The mechanoluminescent material may be disposed in the exterior indentation 82 of all pseudo seams 34 present on the sports ball 10, or the mechanoluminescent material may be selectively disposed in the exterior indentation 82 of one or more select pseudo seams 34 of the sports ball 10.

Figure 11A:
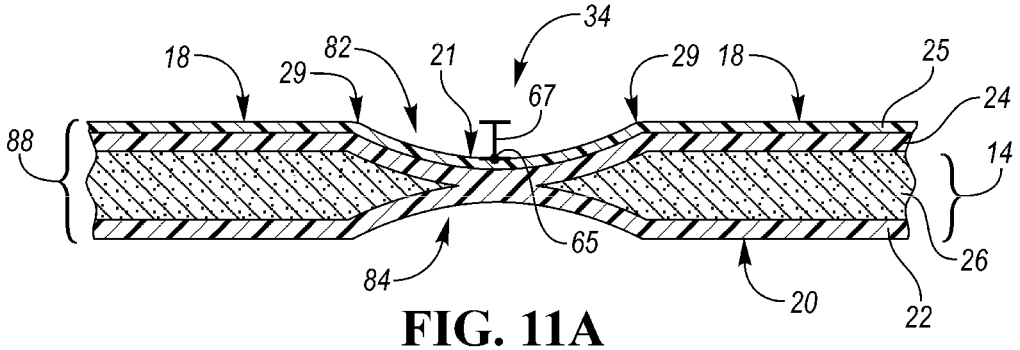
FIG. 11A is an enlarged, schematic, example cross sectional view of an example indentation, wherein the example indentation is defined as a pseudo seam.
Figure 11B:
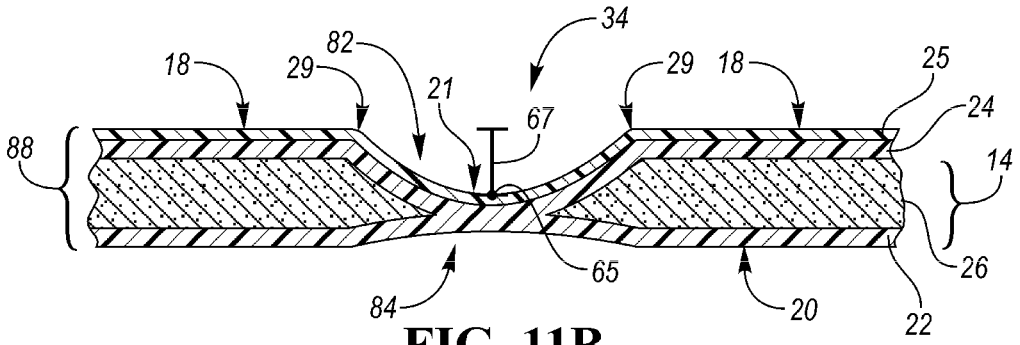
FIG. 11B is an enlarged, schematic, example cross sectional view of another example indentation, wherein the example indentation is defined as a pseudo seam.
Figure 11C:
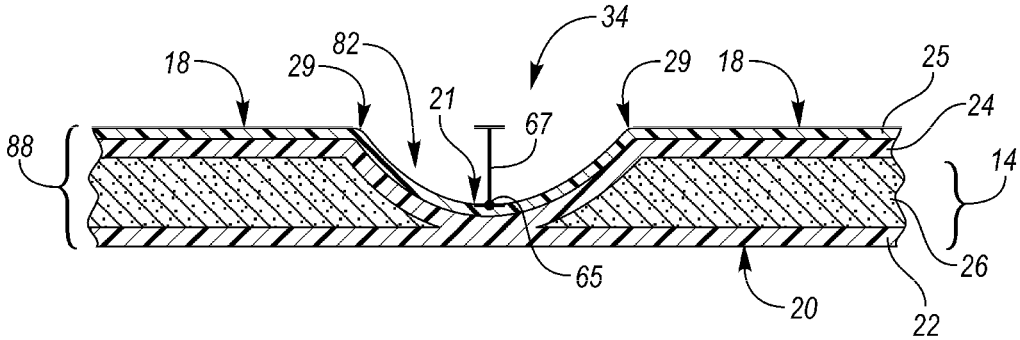
FIG. 11C is an enlarged, schematic, example cross sectional view of another example indentation, wherein the example indentation is defined as a pseudo seam.

The specific configuration of the pseudo seams 34 may vary considerably. Referring to FIG. 11A-11D, the indentations 82 and 84 may have a generally rounded configuration. As depicted in FIG. 11A the indentations 82 and 84 extend to an approximate midpoint of the thickness 88 of the panel cross-section. In another configuration, as depicted in FIGS. 11B and 11C, the exterior indentation 82 extends through more of the thickness 88 of panel cross section than the interior indentation 84. In yet another configuration, as depicted in FIG. 11C, the exterior indentation 82 extends through substantially all of the thickness 88 of panel cross-section. As also shown in FIG. 11C, in some embodiments, the second intermediate layer 22 may have a substantially planar configuration opposite the exterior indentation 82. Said another way, in some embodiments, the pseudo-seam 34 may have only an exterior indentation 82 and no interior indentation 84.

Figure 11D:
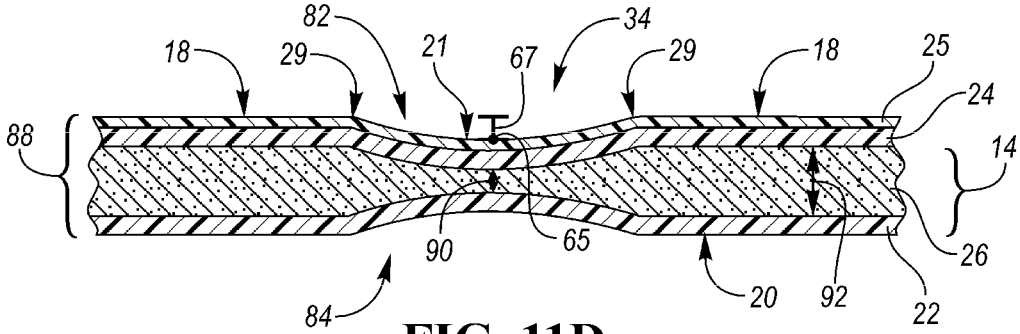
FIG. 11D is an enlarged, schematic, example cross sectional view of another example indentation, wherein the example indentation is defined as a pseudo seam.

Referring to FIG. 11D, indentations 82 and 84, as well as the outer substrate 24 and the second intermediate cover layer 22, may be spaced from each other, such that a portion of the first intermediate layer 26 extends between indentations 82 and 84 and between the outer substrate 24 and the second intermediate cover layer 22. In this configuration, the outer substrate 24 is bonded to the first intermediate layer 26 at the pseudo seam 34. In such an example, the first intermediate layer 26 has a first thickness 90 between indentations 82 and 84 and at the terminus 65 of the exterior indentation 82. In the same example, the first intermediate layer 26 has a second thickness 92 between the outer substrate 24 and the second intermediate cover layer 22, in an area spaced apart from indentations 82 and 84 and the terminus 65 of the exterior indentation 82. As shown in FIG. 11D, the first thickness 90 is less than the second thickness 92.

Figure 11E:
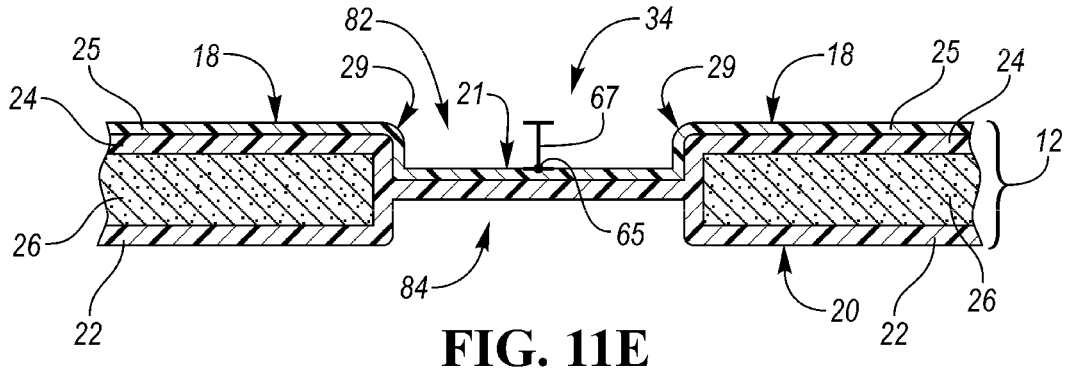
FIG. 11E is an enlarged, schematic, example cross sectional view of another example indentation, wherein the example indentation is defined as a pseudo seam.
Figure 11F:
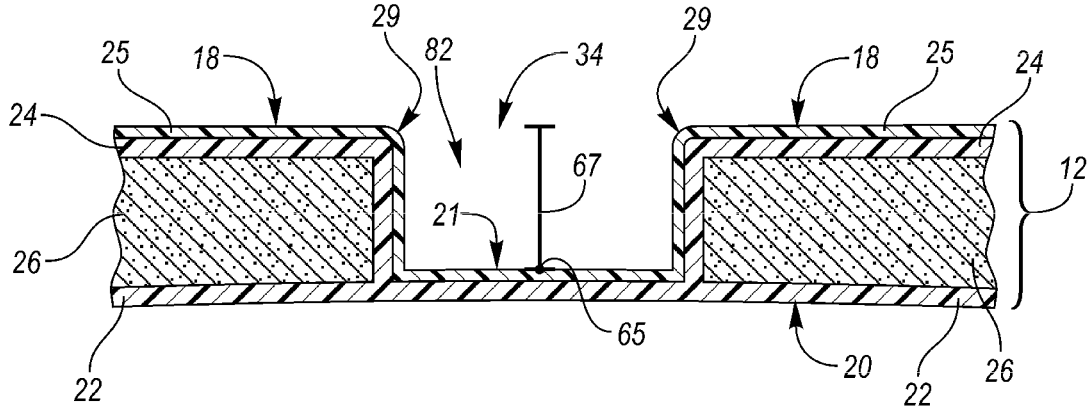
FIG. 11F is an enlarged, schematic, example cross sectional view of another example indentation, wherein the example indentation is defined as a pseudo seam.
Figure 11G:
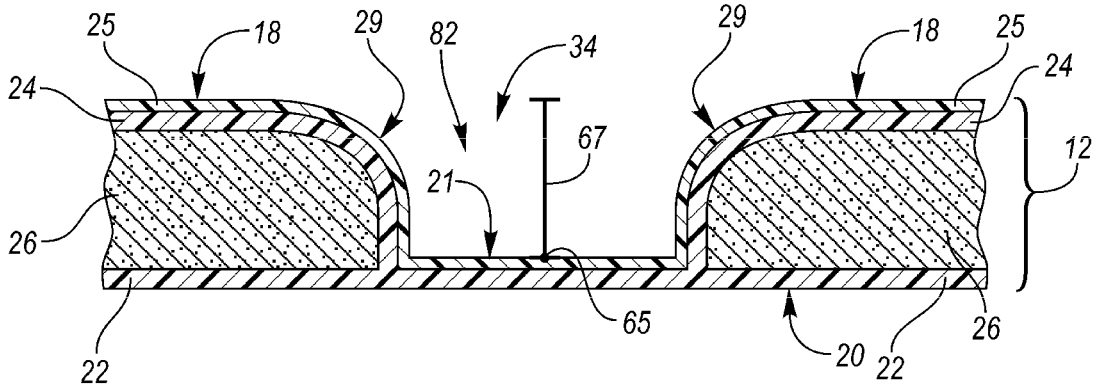
FIG. 11G is an enlarged, schematic, example cross sectional view of another example indentation, wherein the example indentation is defined as a pseudo seam.

Alternatively, the pseudo seams 34 may include an exterior indentation 82 and an interior indentation 84 that exhibit substantially squared configurations (FIGS. 11E-11G). For example, in some embodiments, the indentations 82, 84 may have substantially squared cross-sectional configurations. Such substantially squared cross-sectional configurations may have a more distinct appearance than indentations 82, 84 having substantially rounded cross-sectional configurations. In addition, substantially squared indentations 82, 84 may also provide performance benefits such as aerodynamics, ball feel, and water channeling.

As shown in FIGS. 11E-11F, the exterior indentation 82 and interior indentation 84 are two opposing indentations having substantially squared cross-sectional configurations. In FIG. 11E, the indentations 82 and 84 extend to an approximate midpoint of the thickness 88 of the panel cross-section, such that the terminus 65 of the exterior indentation 82 is positioned on the feature surface 21 at the approximate midpoint of the thickness 88 of the panel cross-section.

In FIGS. 11F-11G, the exterior indentation 82 may extend through substantially the entirety of the thickness 88 of the panel cross section. As also shown in FIG. 11F-11G, in some embodiments, second intermediate layer 22 may have a substantially planar configuration opposite the exterior indentation 82. Said another way, in some embodiments, the pseudo-seam 34 may have only an exterior indentation 82 with and no interior indentation 84.

As shown in FIG. 11G, in one example embodiment, the pseudo seam 34 may include substantially-squared exterior indentation 82 having a rounded shoulder portion 29. In some embodiments, a substantially-squared shoulder portion 29 may have a minimal radius, as shown in FIG. 11F. In another example embodiment, a rounded shoulder portion 29 having a larger radius may be used, as shown in FIG. 11G.

Additionally, pseudo seams 34 may be arranged to form a design that enhances the aesthetics of the ball 10, as shown in FIGS. 9A-9E and 12A-12B. In some configurations, like the one shown by example in FIG. 12A, the pseudo seams 34 may also form indicia 86 identifying the manufacturer of ball 10 (logo or trademark) or conveying information as to the features of ball 10.

Further referring to FIGS. 12A-12B, the pseudo seams 34 may be positioned in the first panel surface 40 of the first panel 30 in a first predefined pseudo-seam panel arrangement 75, and may be further positioned in the second panel surface 42 of the second panel 32 in a second predefined pseudo-seam panel arrangement 76. As shown in FIG. 12A, the first predefined pseudo-seam panel arrangement 75 may be different than the second predefined pseudo-seam panel arrangement 76. As shown in FIG. 12B the first predefined pseudo-seam panel arrangement 75 may be the same as the second predefined pseudo-seam panel arrangement 76.

The positioning of the respective pseudo seams 34 in the respective panel arrangement 75, 76 on the respective panel surface 40, 42 may vary considerably, as shown by example in, but not limited to, FIGS. 3, 10A-10E, and 12A-12B. In some example embodiments, the pseudo seams 34 may be spaced apart from the seams 38 of the sport ball 10. This may facilitate manufacturing by providing substantially smooth surfaces at the peripheral edges of the panels that are joined to one another. In addition, spacing the pseudo seams 34 from the seams 38 may provide performance benefits, such as aerodynamics and ball feel.

In other example embodiments, the pseudo seams 34 may extend to edges 36 of the panels 28, 30, 32 (FIG. 12B) and, thus, continue across a respective seam 38. More particularly, a pseudo seam 34 on the first panel 30 and a pseudo seam 34 on the second panel 40 may be in substantial alignment with one another across a respective seam 38. This may facilitate manufacturing, since multiple panels may be indented simultaneously, for example, by indenting a sheet of outer substrate 24 material, and then cutting the sheet into a plurality of panels 28, 30, 32. This may also enable patterns, arrangements, or other designs to be carried across multiple panels, bridging seams 38 between the panels 28, 30, 32.

In yet another example embodiment, wherein the cover 12 has a substantially uniform or unbroken configuration that does not include panels 28 or includes fewer panels, the pseudo seams 34 may be positioned in areas of the cover 12 that correspond with the positions of seams 38 in a conventional eleven panel sports ball 10, in order to impart the appearance of seams 38.

As shown in FIGS. 3-6 the plurality of protrusions 58, the plurality of land areas 60, and the plurality of pseudo-seams 34 cooperate to define a topographical design 56 on the exterior surface 13 of the sports ball 10. Accordingly, the mechanoluminescent material may be selectively positioned at the respective protrusions 58, seams 38, and pseudo-seams 34 to create a topographical design 56 that illuminates in response to an externally-applied stress or mechanical stimulus. Alternatively, the mechanoluminescent material may be embedded in the outer substrate 24 or the external surface layer 25 and disposed at the land areas 60, such that the land areas 60 illuminate in response to an externally-applied stress or mechanical stimulus and the topographical design 56 remains in the original coloration.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. An inflatable sports ball comprising:

an interior bladder;

a cover disposed about the interior bladder, the cover comprising a plurality of adjoining panels coupled via at least one seam, each of the adjoining panels defining an outer substrate layer, wherein the outer substrate layer defines:

an outer substrate surface and a feature surface, wherein the outer substrate surface and the feature surface cooperate to define an exterior surface of the cover;

at least one indentation defined by the feature surface and spaced apart from the at least one seam, wherein the outer substrate layer is debossed at the at least one indentation, such that the feature surface is radially spaced apart from the outer substrate surface;

a mechanoluminescent material disposed at only one of the outer substrate surface and the feature surface; wherein the mechanoluminescent material emits visible light in response to an externally-applied stress; and wherein:

the outer substrate layer further defines a plurality of land areas defined by the outer substrate surface each of the adjoining panels further includes an intermediate structure, the intermediate structure being disposed between the outer substrate layer and the interior bladder each adjoining panel has a first panel thickness at the land areas; and each adjoining panel has a second panel thickness at the at least one indentation; and the first panel thickness is greater than the second panel thickness the intermediate structure includes a first intermediate cover layer and a second intermediate cover layer, wherein:

the first intermediate cover layer is positioned between the outer substrate layer and the second intermediate cover layer;

the second intermediate cover layer is positioned between the first intermediate cover layer and the interior bladder; and the outer substrate layer is bonded to at least one of the first intermediate cover layer or the second intermediate cover layer at the at least one indentation.

2. The inflatable sports ball of claim 1 wherein the at least one indentation is defined as a plurality of indentations, wherein the plurality of indentations and the plurality of land areas are arranged in an alternating and repeating series of the land areas and indentations, such that each of the plurality of indentations is positioned between a plurality of land areas and each land area is positioned between a plurality of indentations.

3. The inflatable sports ball of claim 1 wherein the mechanoluminescent material is embedded in the outer substrate layer.

4. The inflatable sports ball of claim 3 wherein the mechanoluminescent material is disposed at only the plurality of land areas.

5. The inflatable sports ball of claim 3 wherein the mechanoluminescent material is disposed at the at least one indentation.

6. The inflatable sports ball of claim 1 wherein the inflatable sports ball further includes an external surface layer disposed upon the exterior surface of the cover, and wherein the mechanoluminescent material is embedded in the external surface layer.

7. The inflatable sports ball of claim 6 wherein the mechanoluminescent material is disposed at only the plurality of land areas.

8. The inflatable sports ball of claim 6 wherein the mechanoluminescent material is disposed at only the at least one indentation.

9. An inflatable sports ball comprising:

an interior bladder;

a cover disposed about the interior bladder, the cover comprising a plurality of adjoining panels coupled via at least one seam, each of the adjoining panels defining an outer substrate layer, wherein the outer substrate layer defines:

an outer substrate surface and a feature surface, wherein the outer substrate surface and the feature surface cooperate to define an exterior surface of the cover;

at least one indentation defined by the feature surface and spaced apart from the at least one seam, wherein the outer substrate layer is debossed at the at least one indentation, such that the feature surface is radially spaced apart from the outer substrate surface;

a mechanoluminescent material disposed at only one of the outer substrate surface and the feature surface; wherein the mechanoluminescent material emits visible light in response to an externally-applied stress; and wherein:

the outer substrate layer further defines a plurality of land areas defined by the outer substrate surface; and the cover further comprises at least one protrusion extending from the outer substrate surface, the at least one protrusion having a terminus disposed on the feature surface, such that the terminus is radially spaced apart from the outer substrate surface by a height; and the mechanoluminescent material is disposed at the protrusion.

10. The inflatable sports ball of claim 1 wherein the mechanoluminescent material includes a piezoluminescent material.

11. The inflatable sports ball of claim 1 wherein the mechanoluminescent material includes a triboluminescent material.

12. The inflatable sports ball of claim 1 wherein the mechanoluminescent material is an aluminate material, and wherein the mechanoluminescent material comprises strontium aluminate and europium.

* * * * *